US007966760B2

(12) United States Patent
Fitzpatrick et al.

(10) Patent No.: US 7,966,760 B2
(45) Date of Patent: Jun. 28, 2011

(54) MODULAR GUNSTOCK

(76) Inventors: Richard Mark Fitzpatrick, Broomfield, CO (US); Stephen Charles Hines, Edgewood, NM (US)

( * ) Notice: Subject to any disclaimer, the term of this patent is extended or adjusted under 35 U.S.C. 154(b) by 0 days.

(21) Appl. No.: 10/447,038

(22) Filed: May 27, 2003

(65) Prior Publication Data

US 2004/0055200 A1 Mar. 25, 2004

Related U.S. Application Data

(63) Continuation of application No. 10/180,429, filed on Jun. 25, 2002, now Pat. No. 6,651,371.

(51) Int. Cl.
*F41C 23/14* (2006.01)

(52) U.S. Cl. ..... 42/72; 42/71.03; 42/73; 42/75.03; 42/77

(58) Field of Classification Search ..... 42/71.03, 42/72, 73, 75.03, 77
See application file for complete search history.

(56) References Cited

U.S. PATENT DOCUMENTS

| | | | | | |
|---|---|---|---|---|---|
| 2,900,877 | A | | 8/1959 | McClenahan | 89/173 |
| 3,137,958 | A | * | 6/1964 | Lewis et al. | 42/73 |
| 3,256,632 | A | * | 6/1966 | Beretta | 42/73 |
| 3,267,601 | A | | 8/1966 | Roy | 42/73 |
| 3,348,328 | A | | 10/1967 | Roy | 42/73 |
| 3,442,042 | A | | 5/1969 | Gilbert | 42/73 |
| 4,327,626 | A | | 5/1982 | McQueen | 89/197 |
| 4,430,822 | A | * | 2/1984 | Fromming et al. | 42/71 |
| 4,735,007 | A | | 4/1988 | Gal | 42/73 |
| H486 | H | * | 7/1988 | Savioli | 42/73 |
| 4,766,800 | A | * | 8/1988 | Miller et al. | 89/33.02 |
| 5,173,564 | A | * | 12/1992 | Hammond, Jr. | 42/75.03 |
| 5,235,764 | A | * | 8/1993 | Perazzi | 42/73 |
| 5,305,539 | A | * | 4/1994 | Von Kuster | 42/75.01 |
| 5,367,812 | A | * | 11/1994 | Lautrec | 42/74 |
| 5,410,833 | A | * | 5/1995 | Paterson | 42/73 |
| 5,827,992 | A | | 10/1998 | Harris et al. | 89/191.01 |
| 6,560,911 | B2 | * | 5/2003 | Sharp | 42/73 |
| 6,651,371 | B2 | * | 11/2003 | Fitzpatrick et al. | 42/72 |

FOREIGN PATENT DOCUMENTS

| | | | |
|---|---|---|---|
| DE | 29803775 | * | 7/1998 |
| EP | 0940646 | * | 9/1999 |
| GB | 2332038 | * | 6/1999 |

* cited by examiner

*Primary Examiner* — Michael Carone
*Assistant Examiner* — John Richardson
(74) *Attorney, Agent, or Firm* — Geoffrey E. Dobbin

(57) ABSTRACT

The present invention is a modular stock system for rifles. The system replaces the rifle's buffer tube with a modified one containing a mount for a constant cheek weld and a rail track for adjustment. A stock module then mounts on the replacement buffer tube. The stock module is interchangeable depending on the user's needs. Various configurations of the stock module are discussed, including adjustable stocks, fixed stocks, and specialized stocks. The stock module may be made even further modular by the addition of rail system.

24 Claims, 10 Drawing Sheets

MODULAR GUNSTOCK

CROSS-REFERENCE TO RELATED APPLICATIONS

This application is a continuation application based on earlier filed application Ser. No. 10/180,429, filed on Jun. 25, 2002 now U.S. Pat. No. 6,651,371, said Application hereby incorporated herein by reference.

FIELD OF INVENTION

The present invention relates to a rifle stock and more particularly related to a modular gunstock that provides a constant surface for a uniform cheek weld and the option of a variable length feature.

BACKGROUND OF THE INVENTION

Adjustable gunstocks are known in the prior art. For example, U.S. Pat. No. 4,735,007 to Gal (1988); U.S. Pat. No. 4,327,626 to McQueen (1982); U.S. Pat. No. 3,442,042 to Gilbert (1967); U.S. Pat. No. 3,348,328 to Roy (1966); U.S. Pat. No. 3,267,601 to Roy (1964); U.S. Pat. No. 3,137,958 to Lewis, et al. (1962); U.S. Pat. No. 5,827,992 to Harris, et al. (1998) and U.S. Pat. No. 2,900,877 to McClenahan (1956) are all illustrative of the prior art.

The current standard in automatic and semi-automatic rifles is to have a stock capable of receiving and covering a recoil absorption appendage, or "buffer tube", shown in the '992 and '877 patents. The most popular of the available adjustable stocks follow in form to the '328 patent, which is to say they use a spring loaded latch to bias a pin inside a provided adjustment hole. When a user wishes to adjust the stock, a simple compression of the spring/latch assembly is all that is required to release the pin and, therefore, adjust the stock. The '626 patent operates with a tooth-and-groove assembly which, otherwise, follows the same principles. In both cases, compression of the spring is necessary for adjustment in both directions along any length beyond the proximate hole/groove. All of the adjustable stocks may have their butt portion removed, though they are not designed to have such a feature repeatedly used, much less have additional stock modules to exchange. In those cases where the stock moves longitudinally along the weapon, with no other motion relative to the weapon, the user must make some sacrifice as to one, if not both, of two features. The user either loses constant and uniform cheek weld to the weapon or stock stability. The lack of uniform cheek weld can interfere with comfortable and precise use of the weapon. Stock stability can also interfere with precise weapon use.

While the aforementioned inventions accomplish their individual objectives, they do not describe a truly modular stock, namely a stock where the butt portion is designed to be changed at the whim or need of the user. Likewise, they do not describe a stock that utilizes a cam/tension lock that enables the user to have not only a controlled extension, but also an unrestricted and silent compression and extension of the stock. None of the disclosed stocks have an adjustable preset lock to use in conjunction with an unrestricted adjustment. Finally, none of the disclosed stocks present a surface for a constant cheek weld while simultaneously having a sturdy, longitudal adjustment capable stock, much less a uniform cheek weld with different stock types. In this respect, the gunstock according to the present invention departs substantially from the usual designs in the prior art. In doing so, this invention provides a modular gunstock allowing for a uniform and identical cheek weld for different stock modules, even while simultaneously adjusting the stock length of an adjustable stock.

SUMMARY OF THE INVENTION

In view of the foregoing disadvantages inherent in the known types of gunstocks, this invention provides an improved gunstock. As such, the present invention's general purpose is to provide a new and improved modular gunstock that will have multiple functionality, dependent upon chosen stock modules. The invention will provide simultaneous adjustment of the stock while providing a sturdy, uniform cheek weld on the stock when used with an adjustable stock module. The invention will also provide an identical cheek weld surface with a sturdy stock if a fixed stock is used.

To provide the improved features, the gunstock comprises both a fore and butt portion. The fore portion consists of a buffer tube attachable to the weapon's receiver and a cheek plate extension essentially parallel to the buffer tube. Located on the underside of the buffer tube is a rail track. The rear portion consists of a receiving cylinder of sufficient length and width to receive the buffer tube of the fore portion. Located on the lower rim of the cylinder is the compression latching mechanism, designed to interface with the rail track. Rearward of the receiving cylinder is the stock butt and any other accessories as required by the user. In the preferred embodiment, the cheek plate is fused to the buffer tube, presenting a wider rest for a user's cheek, and the rear portion comprises a receiving cradle, or semi-cylinder, which interfaces along a pair of attachment grooves located on either side of the buffer tube, having a distal relation with the cheek plate The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
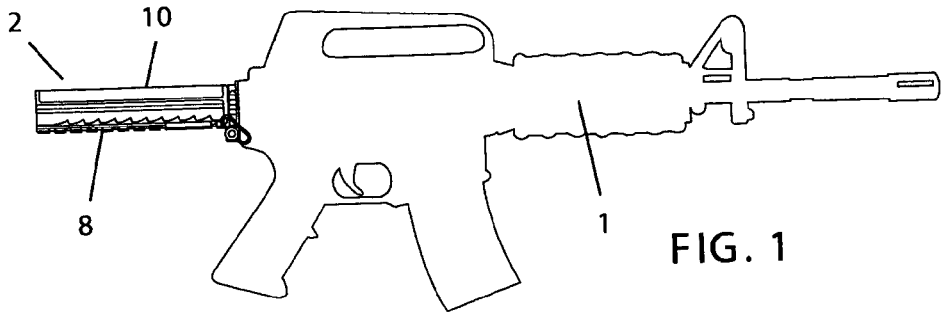
FIG. 1 is a side elevation of a rifle with the modified buffer tube according to the present invention.
Figure 1A:
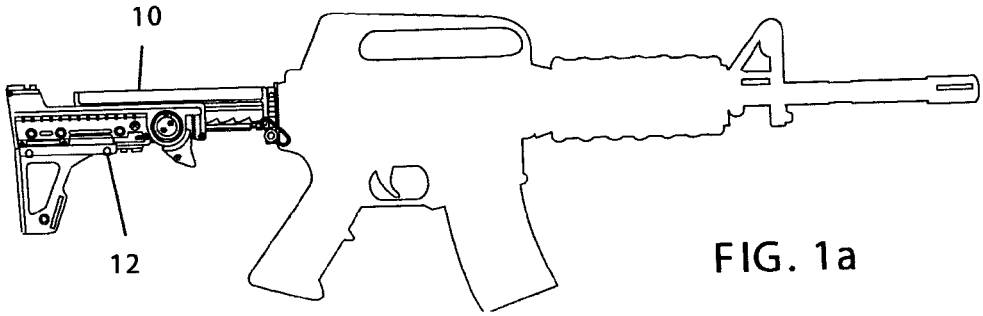
FIG. 1*a* is the rifle of FIG. 1 with an adjustable stock attachment.
Figure 1B:
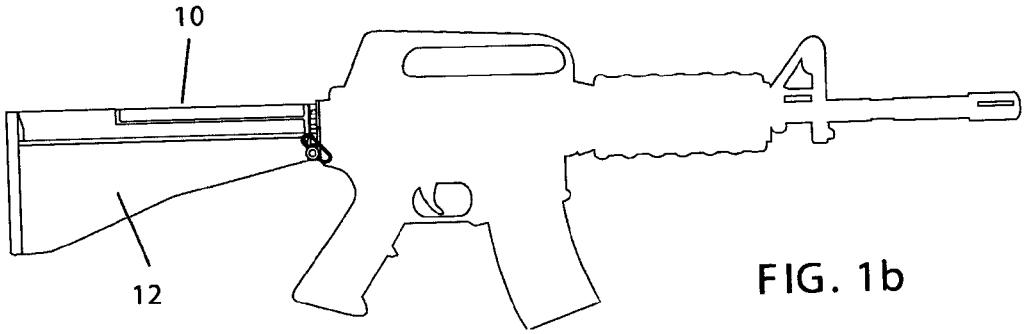
FIG. 1*b* is the rifle of FIG. 1 with a fixed stock attachment.
Figure 1C:
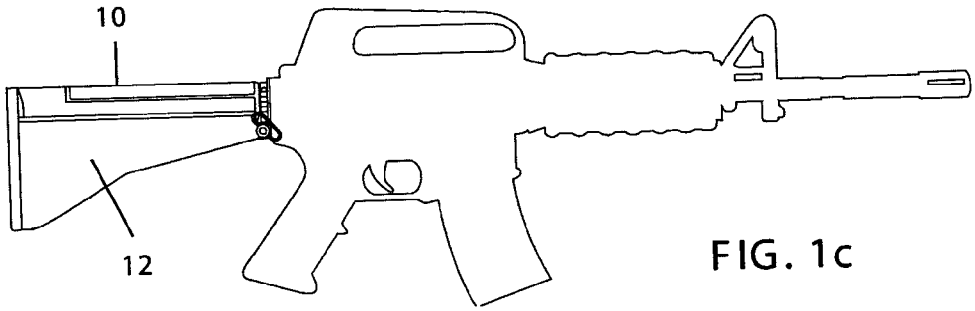
FIG. 1*c* is the rifle of FIG. 1 with a "shorty" fixed stock attachment
Figure 2:
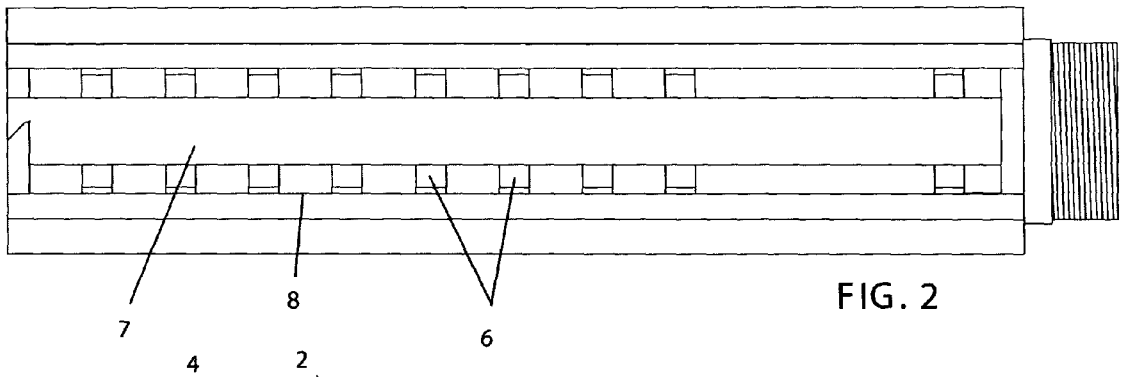
FIG. 2 is a bottom plan view of the modified buffer tube module.
Figure 3:
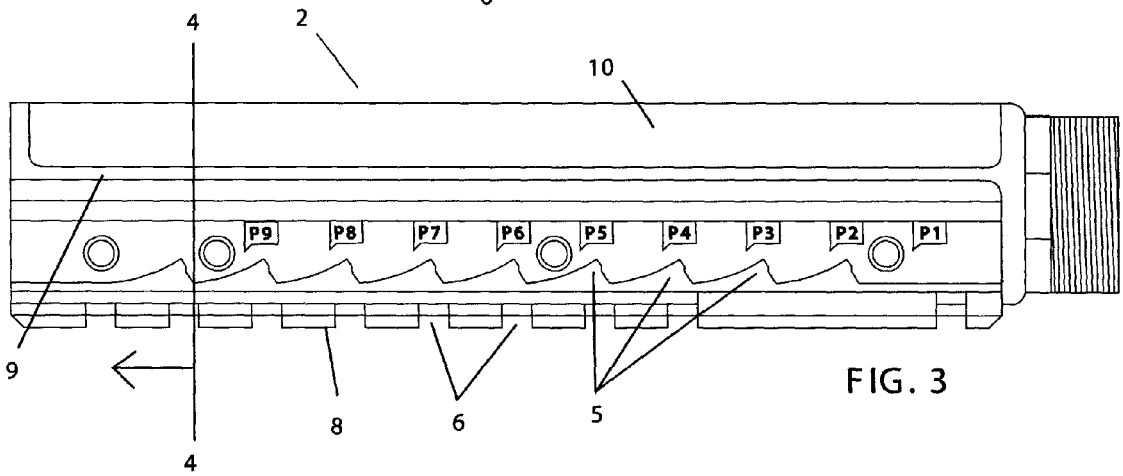
FIG. 3 is a side elevation of the modified buffer tube module.
Figure 4:
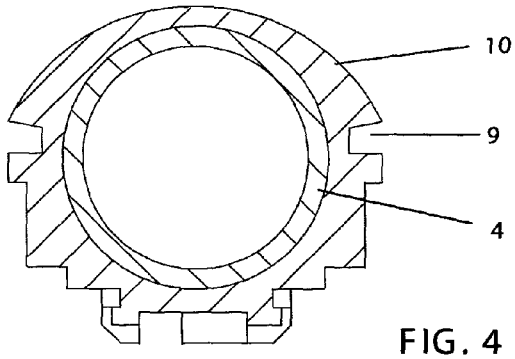
FIG. 4 is a cross section of the buffer tube module of FIG. 3 taken at line 4.

With reference now to the drawings, the preferred embodiment of the modular gunstock will be explained. With reference to FIGS. 1, 1*a*, 1*b*, 1*c*, the gunstock is composed of a modified buffer tube module 2 and a stock module 12. Buffer tube 2 fits on rifle 1 by replacing the existing buffer tube of the rifle with the buffer tube module 2. In addition, referencing FIGS. 3 and 4, rail track 8, with individual lateral grooves 6 and single transverse groove 7, is disposed towards the ground and cheek mount 10 is disposed upwards and is generally parallel to buffer tube 4. Two longitudinal tracks 9 are disposed slightly underneath cheek plate 10 providing attachment tracks for stock module 12. Ideally, the cheek plate 10 is fused onto the buffer tube 2. However, in alternative embodiments, enough space can be left between buffer tube 4 and cheek plate 10 to allow for unhindered motion of a cylindrical stock module. Tooth interfaces 5 are disposed underneath the longitudinal tracks 9.

Figure 5A:
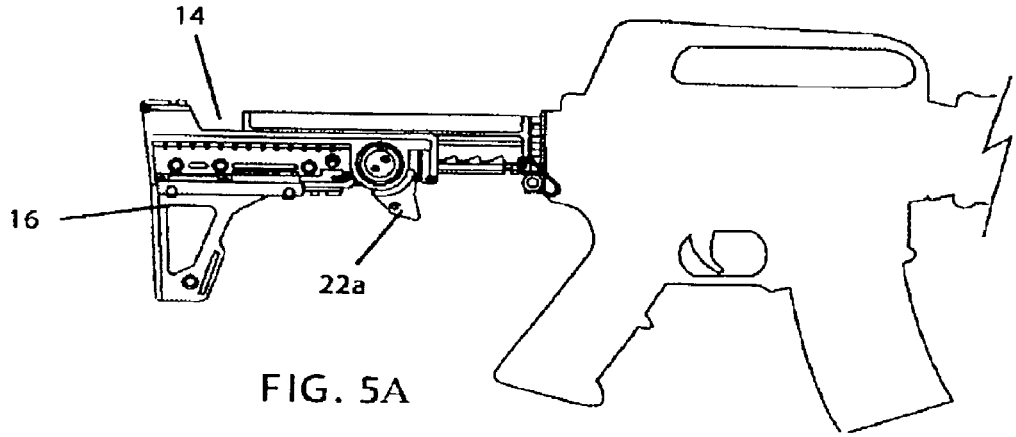
FIG. 5*a*-5*c* are three side elevations showing the use of the adjustable stock embodiment.
Figure 5B:
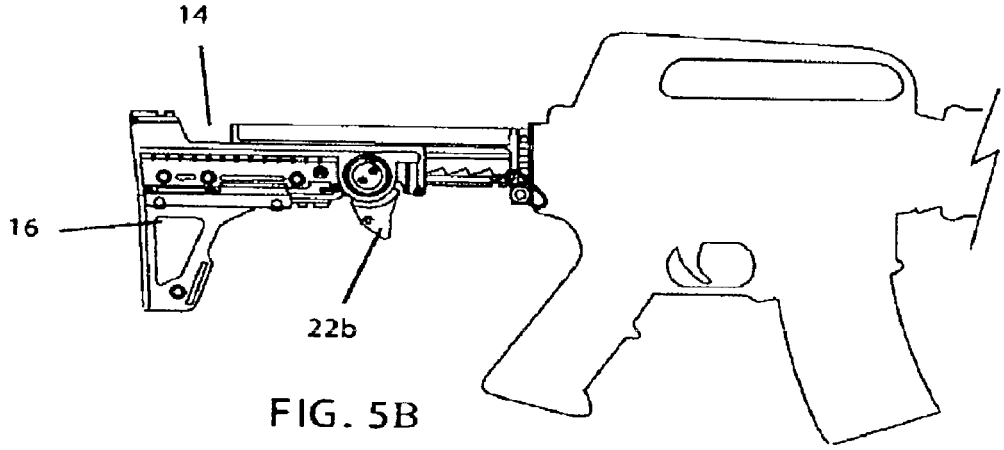
Figure 5C:
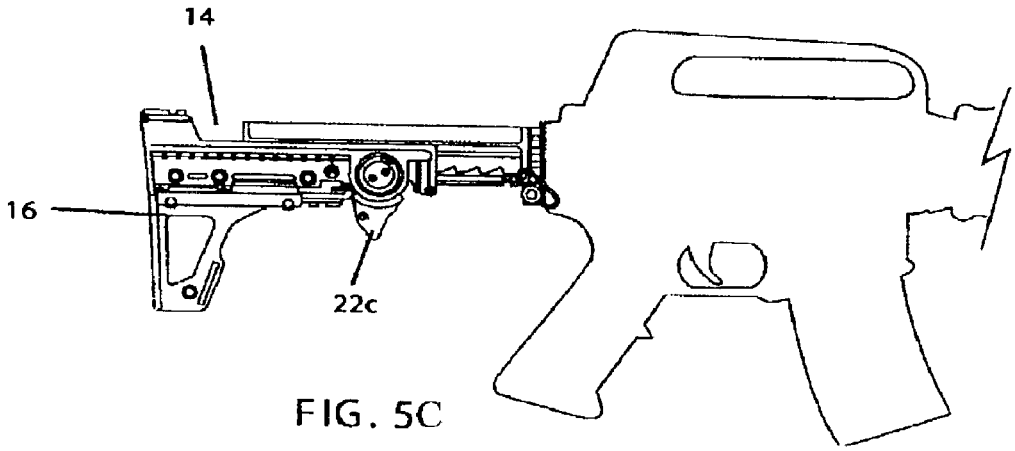
Figure 6:
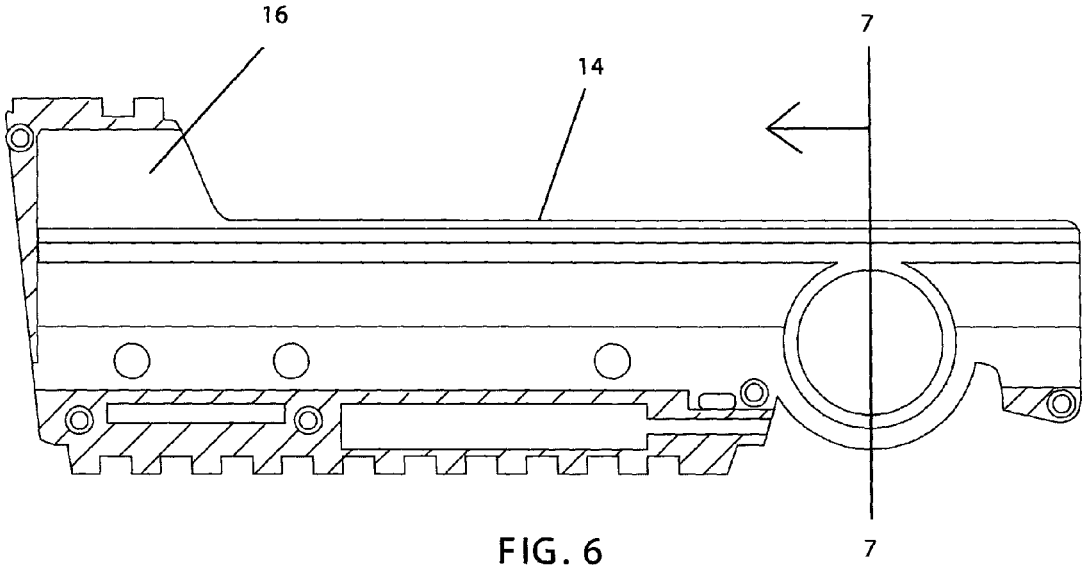
FIG. 6 is a side plan view of an adjustable stock module.
Figure 7:
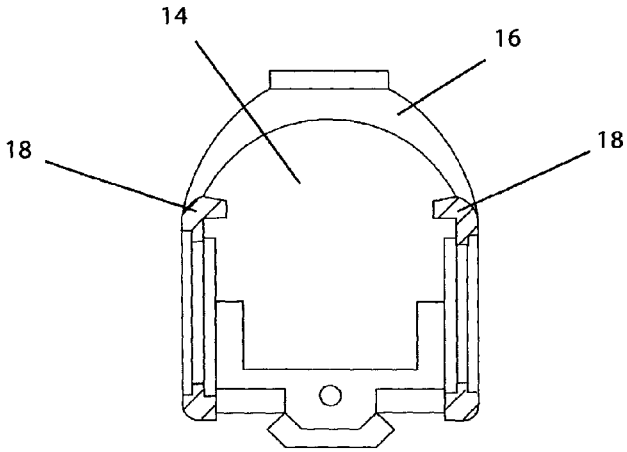
FIG. 7 is cross-section view of the module of FIG. 6, taken along line 7.
Figure 14:
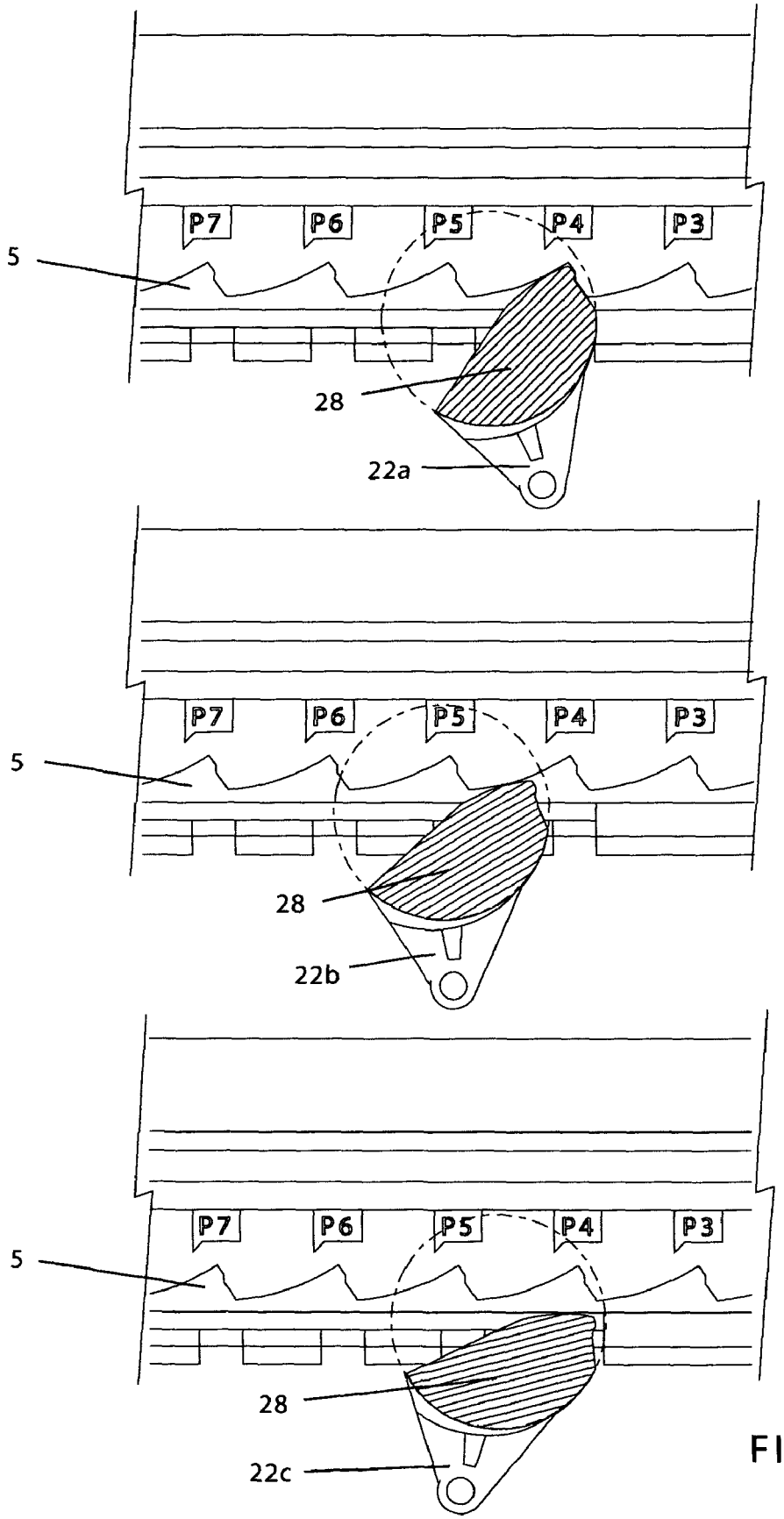
FIG. 14 is a three-staged partial cross section of the modular stock of FIG. 5.

Referring to FIGS. 6 and 7, stock module 12 has a receiving cradle 14 that fits over buffer tube module 2. Two attachment rails 18 are disposed at the upper two edges of the cradle 14. Behind receiving cradle 14 is the butt 16 of the stock. Butt 16 may be modified in various configurations, depending on the needs of the user, shown in FIGS. 10*a*-*e* and 11*a*-*c*. In the adjustable embodiment shown in FIG. 1*a*, latching mechanism 20 interfaces with rail track 8 via a double cusped tooth 28 and cam mechanism, shown in detail in FIGS. 12, 13 and 14. Latch switch 24 has three settings, shown in FIGS. 5 and 14, which activate compression mechanism 26 to bias tooth 28 against tooth interface 5. As tooth 28 is further biased against interface 5, stock module 12 is locked into relative position against the buffer tube module 2. Tooth 28 has a forwards disposed angle 30, which, at the proper setting, allows for extension of the stock while prohibiting compression. In the locked setting, cam anchor 32 (shown in FIGS. 12 and 13) is biased into the rail track 8 in one of the lateral grooves 6, while tooth 28 is locked into a non-movable interface with tooth interface 5. This construction allows a three point locking system that gives more security and stability than the prior art single point locking systems. In FIGS. 5 and 14, 22*a* depicts a locked setting; 22*b* depicts an extension only setting; and 22*c* depicts a free motion setting. In all embodiments, rails 18 are slid through tracks 9 for proper guidance and hold. In fixed stock configurations, such as FIGS. 1*b* and 1*c*, a latching mechanism may be employed or a pinning system may be utilized.

Figure 8:
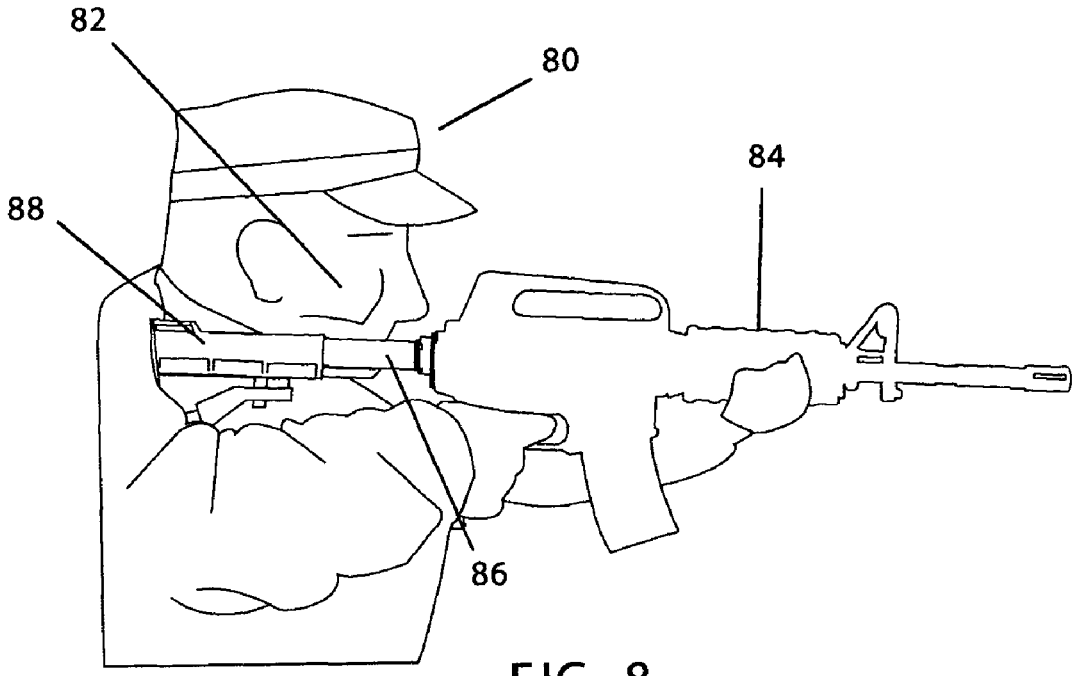
FIG. 8 is a side elevation depicting the use of the current standard adjustable stock.
Figure 9:
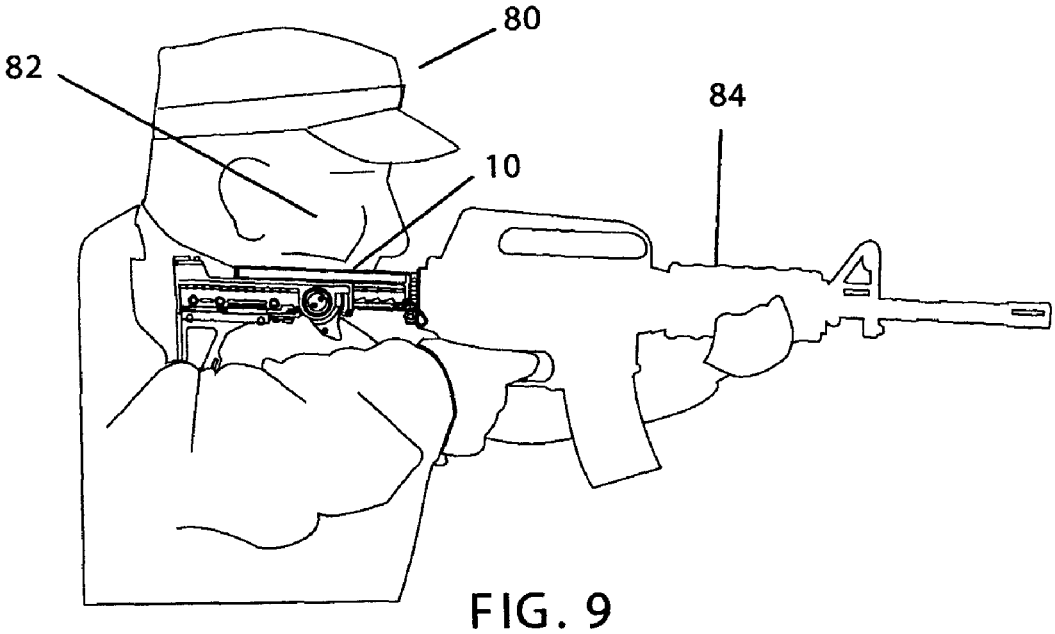
FIG. 9 is a side elevation depicting the use of the present invention with an adjustable stock module.

FIG. 8 shows the prior art adjustable stock configuration. Notice that user 80 places cheek 82 against the weapon 84. Cheek 82 is positioned against the juncture of the fore 86 and hind 88 portions of the stock. This not only causes discomfort but also interferes with the use of the weapon. FIG. 9 shows use of the present invention. User's cheek 82 is now placed against cheek plate 10, eliminating discomfort and minimizing disruption caused by placement at the juncture as in the prior art.

Figure 10A:
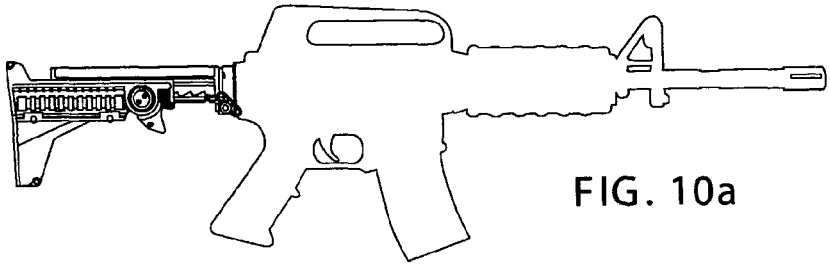
FIGS. 10*a* through 10*e* depict side elevations of suggested stock options.
Figure 10B:
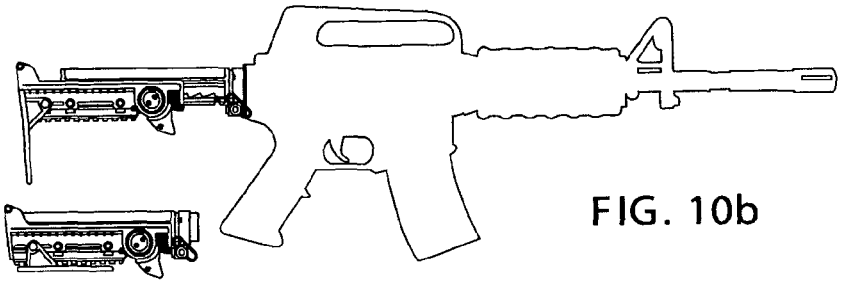
Figure 10C:
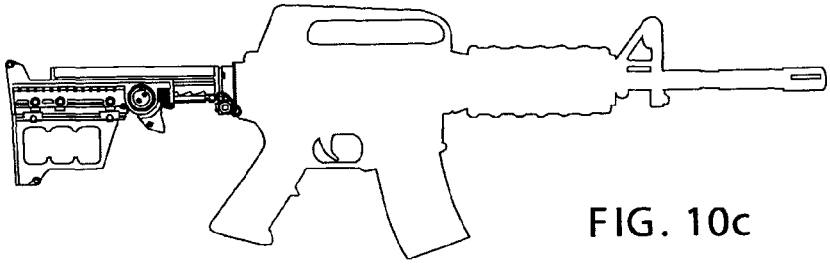
Figure 10D:
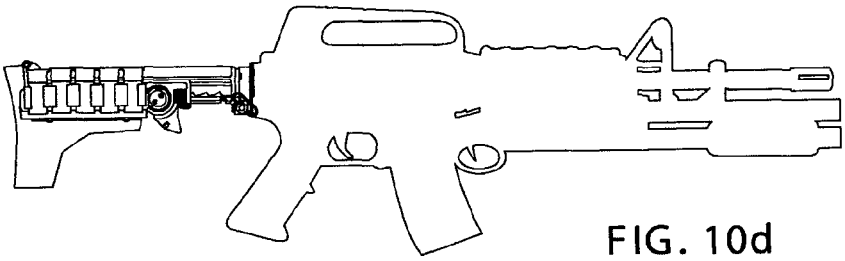
Figure 10E:
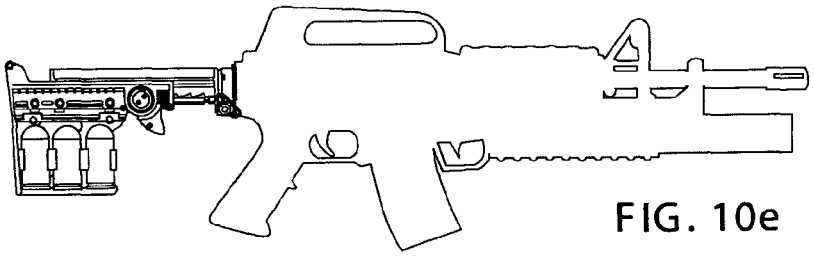
Figure 11A:
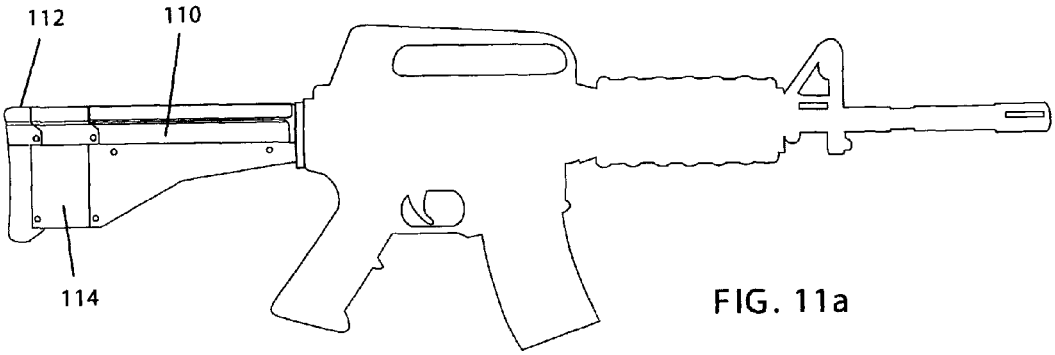
FIGS. 11*a* through 11*c* are side elevations of a specialized stock option that has further modularity.
Figure 11B:
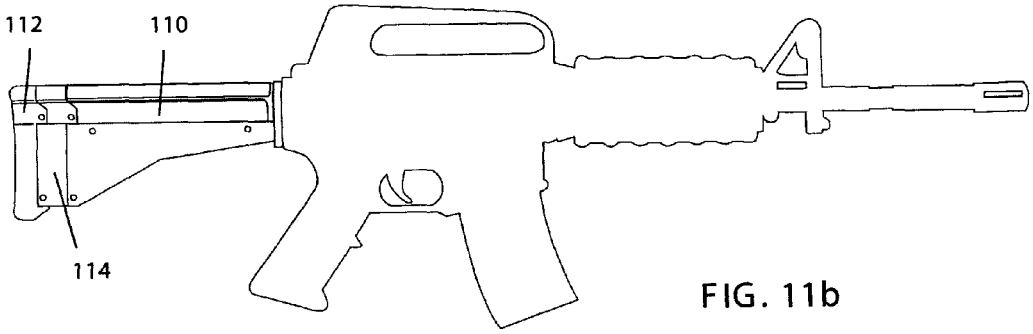
Figure 11C:
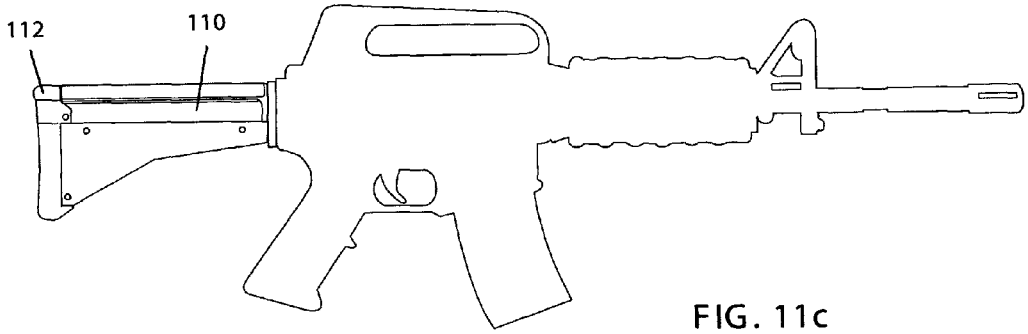

In keeping with the modularity of the present invention, numerous configurations of stock module 12 may be used for various uses. All of which are made to interface with the replacement buffer tube 4. Shown in FIGS. 10*a*-10*e* are five such configurations for adjustable stocks. FIG. 10*a* depicts a carbine stock; 10*b* a foldable stock; 10*c* an adjustable stock with a battery pack. FIGS. 10*d* and 10*e* depict mounting systems for ammunition for additional mounted weapon attachments. FIGS. 11*a*-11*c* displays a further modular fixed stock. Stock module 112 may be extended away from stock base 110 as needed for spacer 114. Spacer 114 may be a battery pack, a simple extension or anything a user desires. An additional side mounting rail systems may also be added to any stock module.

Figure 12:
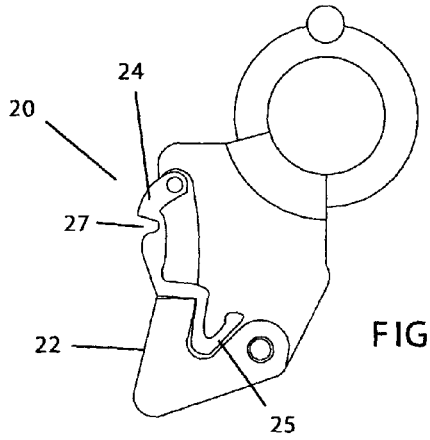
FIG. 12 is a cross-section view of the latching mechanism.
Figure 13A:
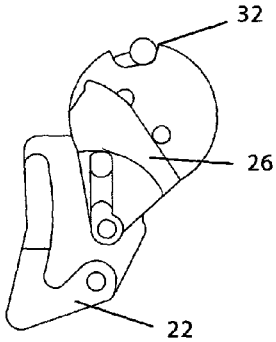
FIGS. 13*a*-*f* display a blown-apart view of the latching mechanism.
Figure 13C:
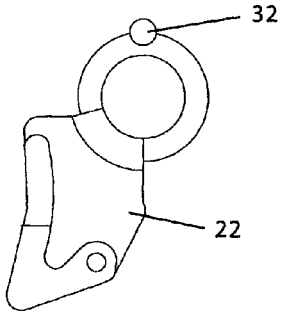
Figure 13E:
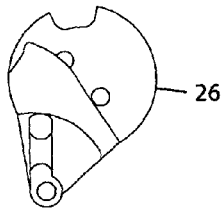
Figure 13B:
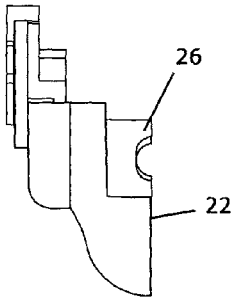
Figure 13D:
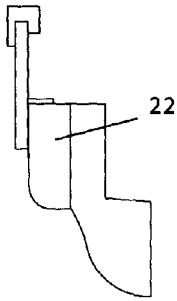
Figure 13F:
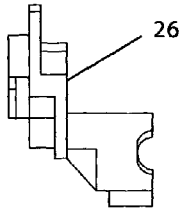

The present invention utilizes a compression, or "cam", latch with adjustable modules, shown in better detail in FIGS. 12, 13 and 14. It incorporates a latch body 22, divided in two halves, a safety latch 24 attached to a spring mount 25 with a safety tooth 27, and a bicuspid latch tooth 28 and an associated cam mechanism 26. Latch 20 is axially mounted about two mounting holes 34, one in each half 22, in a manner to interface with rail track 8 and tooth interfaces 5, shown in FIGS. 3 and 4. Latch 20 has three settings. Latch body 22 is pulled backwards to disengage latch tooth 28 from tooth interfaces 5. This setting allows free adjustment, forwards and backwards, of the module. Cam mechanism 26 operates to bias latch tooth 28 into a middle, ratcheting position. The latch tooth has a forwards-facing angle 30, which allows latch tooth 28 to catch the rail track if the stock module is pushed forwards, but disengages from tooth interfaces 5 for backwards extension. The final position is a locked position which forces latch tooth 28 into an almost vertical position. Cam anchor 32 is also forced into rail track groove 6. Safety latch 24 is forced to interface with the stock module with its safety tooth 27 by spring mount 25. The interface prevents latch body 22 from being compressed accidentally. Spring mount 25 is embedded into latch body 22 in such a manner that when safety latch 24 is mounted upon it, safety latch 24 is flush with latch body 22.

Figure 15:
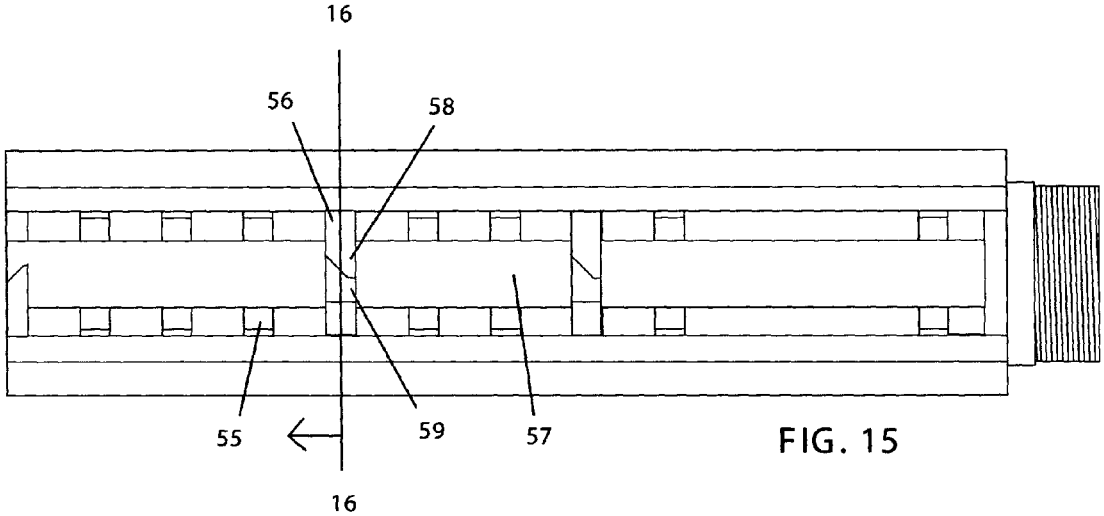
FIG. 15 is a bottom plan view of the buffer tube module and associated preset system.
Figure 16:
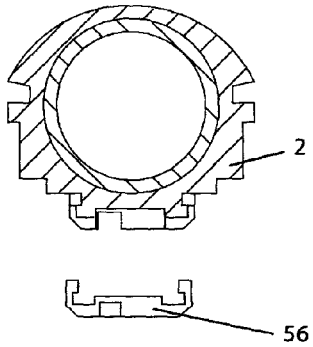
FIG. 16 is a cross section view of the buffer tube module of FIG. 15, with the preset clip removed, taken along line 16.
Figure 17:
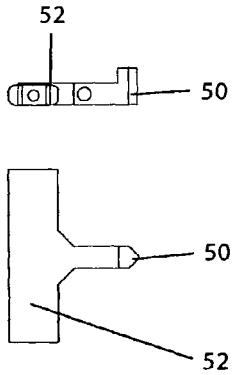
FIG. 17 is two close up views of the preset tooth.

In an alternate embodiment, shown in FIGS. 15, 16, and 17, a catch tooth 50 is disposed above the latching mechanism to interface with transverse channel 57. Catch tooth 50 is mounted upon catch base 52, forming a shape reminiscent of a capital "T", and is biased by spring 54 into a central position. Stop bar 56 is a clip insertable into the lateral grooves 55 of transverse channel 57. Stop bar 56 has a groove 59 corresponding with transverse channel 57 except that groove 59 is almost dissected by projection 58, leaving enough room for tooth 50 to pass through if biased to one side. In so doing, a preset function is added to this embodiment. A user simply inserts a stop bar at a desired length. When extending the stock module, tooth 50 will be blocked by projection 58, thus arresting extension of the stock module. To pass the stop bar, the user presses stop base 52 to one side, allowing tooth 50 to pass. A spring then returns tooth 50 to a central position when pressure is released. A second stop bar, possibly with projection 56 facing a different direction, may be added for further security. In addition, the back of the transverse groove 57 may be fashioned with such a projection to prevent the stock module from accidentally being pulled off the buffer tube module.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A modular stock system for a rifle comprising:

a. A replacement buffer tube module having upper and lower sides, the lower side being the side disposed towards the ground, said buffer tube module having attachment means, the attachment means further comprising a plurality of longitudinally disposed attachment tracks;

b. A replaceable stock module attachable on the buffer tube module via the attachment means; and c. the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube wherein the stock module is selectable from a group of assorted hind segments adapted to different functions.

2. The modular stock system of claim 1, the buffer tube module further comprising:

a cheek plate being an upper surface of the buffer tube, thereby leaving no space between it and the buffer tube;

and the stock module further comprising:

a. A receiving cradle, defined by two ends vertically extending from a bottom portion;

b. Two attachment rails, one disposed on each end;

c. A stock portion, disposed in a rearward direction relative to the receiving cradle;

wherein, the stock module mounts on the attachment tracks and thereby leaves the cheek plate exposed for use.

3. The modular stock system of claim 2, the attachment means of the buffer tube module further comprising and the stock module's attachment means further comprises a compression latch mechanism, the mechanism comprising:

a. At least one bicuspid tooth, with sufficient width to allow the cusps to interface with tooth interfaces on opposite sides of the buffer tube module b. a mechanism for displacement of the tooth;

c. a mechanism actuator;

wherein, the actuator may be used to bias the tooth into and out of the tooth interfaces and therefore lock the stock module into a position relative to the buffer tube module.

4. The modular stock system of claim 3 wherein the tooth and tooth interfaces are disposed at complimentary angles to one another, and the mechanism primarily displaces the tooth in an angular manner, thereby allowing unilateral motion of the stock module relative to the buffer tube module.

5. The modular stock system of claim 4, the mechanism of which further comprising a cam anchor that is vertically displaced into a rail track located on the lower side of the buffer tube module when the actuator is moved into a locked position.

6. The modular stock system of claim 5, the mechanism of which further comprises a safety latch, designed to releasably interface with the stock module when the actuator is moved into a locked position, thereby arresting motion of the actuator and associated mechanism.

7. A modular stock system for a rifle comprising:

a. A replacement buffer tube module having upper and lower sides, the lower side being the side disposed towards the ground, said buffer tube module further comprising;

i. a cheek plate being an upper surface of the buffer tube, thereby leaving no space between it and the buffer tube;

ii. an adjustment rail track located underneath the buffer tube module;

iii. a plurality of longitudinally disposed attachment tracks;

iv. a plurality of pairs of tooth interfaces, one of each pair being organized in a one of two parallel rows of tooth interfaces, disposed below the attachment tracks, and b. A replaceable stock module attachable on the buffer tube module via the attachment means, said stock module further comprising;

i. A receiving cradle, defined by two ends vertically extending from a bottom portion;

ii. Two attachment rails, one disposed on each end;

iii. A stock portion, disposed in a rearward direction relative to the receiving cradle;

iv. a compression latch mechanism, the mechanism still further comprising:

1. At least one bicuspid tooth, with sufficient width to allow the cusps to interface with tooth interfaces on opposite sides of the buffer tube module 2. a mechanism for displacement of the tooth;

3. a mechanism actuator; the tooth and tooth interfaces being disposed at complimentary angles to one another, and the mechanism primarily displacing the tooth in an angular manner into and out of the tooth interfaces, thereby locking and unlocking the stock module relative to the buffer tube module while allowing unilateral motion of the stock module relative to the buffer tube module while in a quasi-locked position; and v. an interface system for interaction with the rail track wherein the stock module is selectable from a group of assorted hind segments adapted to different functions.

8. The modular stock system of claim 7, the interface system further comprising a clip and the rail track further comprises a groove transecting the entire length of the rail track, wherein the clip is insertable into a portion of the transecting groove so as to provide a pre-set stop for a longitudinally adjustable hind segment.

9. The modular stock system of claim 7 further comprising a pre-set stopping system for an adjustable for length stock attachment, the system further comprising:

a. A longitudinal channel transecting the length of the rail track;

b. A preset latch located in the stock module so as to interface with the channel, the preset latch having a tooth capable of horizontal motion relative to the stock module within the channel;

c. At least one spring to bias the tooth in a central orientation;

d. A clip, insertable within the rail track, having a horizontal groove which is partially blocked by a body, leaving enough space for the tooth to pass through when said tooth would be biased to one side;

wherein, when the clip is inserted into the rail track the groove aligns with the channel and is capable of interfacing with the tooth during longitudinal motion of the stock module relative to the buffer tube module, said tooth capable of bypassing the clip when biased to one side, but may not pass the clip otherwise.

10. The modular stock system of claim 9, the body blocking the groove shaped at an angle in one direction, wherein the stock module is then capable of bypassing the clip in one direction, but not the other without biasing the tooth.

11. The modular stock system of claim 10, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

12. The modular stock system of claim 9, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

13. The modular stock system of claim 8, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

14. The modular stock system of claim 7, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

15. A modular stock system for a rifle comprising:

a. A replacement buffer tube module having upper and lower sides, the lower side being the side disposed towards the ground, said buffer tube module comprising:

i. attachment means, the attachment means further comprising a plurality of longitudinally disposed attachment tracks;

ii. a raised cheek plate disposed towards an upper end of the buffer tube module; and iii. an adjustment rail track, located underneath the buffer tube module; and b. A replaceable stock module attachable on the buffer tube module via the attachment means, said stock module further comprising an interface system for interaction with the rail track;

wherein the stock module is selectable from a group of assorted hind segments adapted to different functions and slideable underneath the cheek plate.

16. The modular stock system of claim 15, the interface system further comprising a clip and the rail track further comprises a groove transecting the entire length of the rail track, wherein the clip is insertable into a portion of the transecting groove so as to provide a pre-set stop for a longitudinally adjustable hind segment.

17. The modular stock system of claim 15 further comprising a pre-set stopping system for an adjustable for length stock attachment, the system further comprising:

a. A longitudinal channel transecting the length of the rail track;

b. A preset latch located in the stock module so as to interface with the channel, the preset latch having a tooth capable of horizontal motion relative to the stock module within the channel;

c. At least one spring to bias the tooth in a central orientation;

d. A clip, insertable within the rail track, having a horizontal groove which is partially blocked by a body, leaving enough space for the tooth to pass through when said tooth would be biased to one side;

wherein, when the clip is inserted into the rail track the groove aligns with the channel and is capable of interfacing with the tooth during longitudinal motion of the stock module relative to the buffer tube module, said tooth capable of bypassing the clip when biased to one side, but may not pass the clip otherwise.

18. The modular stock system of claim 17, the body blocking the groove shaped at an angle in one direction, wherein the stock module is then capable of bypassing the clip in one direction, but not the other without biasing the tooth.

19. The modular stock system of claim 18, the buffer tube of which further comprises a removable and rotatable end cap, which is sized to fit a threaded interior surface of the buffer tube.

20. The modular stock system of claim 19, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

21. The modular stock system of claim 18, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

22. The modular stock system of claim 17, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

23. The modular stock system of claim 16, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

24. The modular stock system of claim 15, the attachment means further comprising a clipping means and at least one hole capable of receiving a clipping means built into the buffer tube and at least one corresponding hole located on the hind segment in a manner to juxtapose the buffer tube and segment's holes when the hind segment is appropriately positioned on the buffer tube wherein the clipping means may be inserted through the holes and thus secure the hind segment to the buffer tube.

* * * * *